US006332376B1

(12) United States Patent
Hurley

(10) Patent No.: US 6,332,376 B1
(45) Date of Patent: Dec. 25, 2001

(54) HAMMER WITH REPLACEABLE NAIL STRIKING HEAD

(76) Inventor: Harold J. Hurley, 424 Angus, Gretna, NE (US) 68028

( * ) Notice: Subject to any disclaimer, the term of this patent is extended or adjusted under 35 U.S.C. 154(b) by 0 days.

(21) Appl. No.: 09/559,150

(22) Filed: Apr. 26, 2000

Related U.S. Application Data

(63) Continuation-in-part of application No. 09/111,912, filed on Jul. 8, 1998, now abandoned.

(51) Int. Cl.[7] ..... B25D 1/00
(52) U.S. Cl. ..... 81/23; 7/144
(58) Field of Search ..... 81/23, 24, 25; 7/144

(56) References Cited

U.S. PATENT DOCUMENTS

| | | | | |
|---|---|---|---|---|
| 886,987 | * | 5/1908 | Kiehl | 7/144 |
| 976,679 | * | 11/1910 | Morrison | 81/23 |
| 2,983,297 | * | 5/1961 | Wilson | 81/23 |
| 3,211,198 | * | 10/1965 | Glasgow | 81/25 |
| 3,763,906 | * | 10/1973 | Crowder | 81/25 |
| 3,769,644 | * | 11/1973 | Case | 7/144 |
| 3,774,252 | * | 11/1973 | Cantales | 7/105 |
| 4,139,930 | * | 2/1979 | Cox | 81/26 |
| 4,291,736 | * | 9/1981 | Robertson et al. | 81/25 |
| 5,119,699 | * | 6/1992 | McBride et al. | 81/25 |

* cited by examiner

*Primary Examiner*—Joseph J. Hail, III
*Assistant Examiner*—David B. Thomas

(57) ABSTRACT

A hammer includes an elongated handle having a top end and a bottom end and a hammer head mounted on the top end of said handle, the hammer head including a body section and a rigid nail striking head section having a nail striking face. A nail pulling device is mounted on the handle, the nail pulling device having a nail-engaging plate and at least one generally keyhole-shaped slot formed therein, the slot including an access opening having a relatively wide transverse dimension sized to receive a nail head therethrough and a narrowed groove section having a transverse dimension smaller than the transverse dimension of the access opening and sized to inhibit passage of a nail head therethrough, the nail pulling device operating such that the head of a nail to be pulled is moved through the access opening of the slot and the hammer is positioned to secure the nail in the groove section.

5 Claims, 4 Drawing Sheets

HAMMER WITH REPLACEABLE NAIL STRIKING HEAD

CROSS-REFERENCE TO RELATED PATENT

This continuation-in-part application claims priority based on a previously filed patent application, specifically on patent application Ser. No. 09/111,912 filed Jul. 8, 1998 now abandoned.

BACKGROUND OF THE INVENTION

1. Technical Field

The present invention relates to hammers and, more particularly, to a hammer which includes an elongated handle and a hammer head having a body section mounted on the elongated handle and removably replacement mounted head section connected to the body section, the head section including at least one coaxially extending nail support groove and a magnet structure rearward of the nail support groove for loosely securing a nail in the groove.

2. Description of the Prior Art

Various types of hammers are used in the construction industry, including framing hammers, finishing hammers, rigging axe hammers, etc. . . Each of these hammers is constructed in a similar manner using similar materials, namely, each hammer would generally include an elongated handle on top of which is mounted a hammer head of varying size and/or shape, but which includes a nail striking face one at least one end thereof. The hammer head would be secured on the handle by a wedge or the like driven into the top of the handle which presses the sides of the handle against the interior of the hammer head. The hammer is then ready for use.

Of course, there are several inherent defects in standard hammer construction which are usually not addressed due to the relatively low price of purchase for a new, replacement hammer. Chief among these defects is that the nail striking face of the hammer will in all likelihood wear out long before the rest of the hammer is worn. With common hammers, the solution is to go purchase another hammer. However, the more expensive the hammer being used, the less cost-efficient it is to merely replace the hammer, particularly in connection with framing hammers or the like which can cost upwards of $60.00 U.S. There is therefore a need for a hammer which includes a replaceable nail striking face and head.

Another problem encountered in the art of hammers is that many different types of hammers may need to be used during the work on a single job site. For example, framers will use two types of framing hammers, one having a corrugated face for use in rough framed areas and the other having a smooth face for use in finished framed areas. This means that the framer must carry two hammers on his or her tool belt, which can be inconvenient. Furthermore, if the framer is also working on another job at the same time as the framing is taking place, a third and even a fourth hammer having lighter head weights may need to be carried. There is therefore a need for a hammer which has a switchable striking head for quick and easy exchanging of head types without requiring a separate hammer to be carried.

Another common problem encountered in the use of hammers is that the handle of the hammer may break without warning, resulting in the hammer being unusable. The hammer would be discarded and a new hammer would have to be purchased. Not only is it expensive to replace the hammer, but valuable job site time is lost during the time the replacement hammer is being found. It would certainly solve the problem if it were possible to merely replace the hammer handle in a quick and simple manner, and therefore there is clearly a need for this ability.

Finally, it is common to find the nail pulling claw of the hammer on the head of the hammer opposite the nail striking face. While the nail pulling claw is useful in many situations demanding the removal of nails, it is not always easy to use the claw in all situations, particularly those requiring the removal of nails in tight quarters. There is therefore a need for a nail removal device fitted on the hammer which can be used for the removal of nails in tight or narrow spaces.

Therefore, an object of the present invention is to provide a hammer having a replaceable nail striking head.

Another object of the present invention is to provide a hammer having a replaceable nail striking head which can be fitted with a variety of nail striking heads, from heavy corrugated framing hammer heads to light smooth finishing hammer heads.

Another object of the present invention is to provide a hammer having a replaceable nail striking head which includes an elongated handle releasably attached to the hammer head such that upon the handle breaking or fracturing, the broken handle may be quickly and easily replaced with a new intact handle.

Another object of the present invention is to provide a hammer having a replaceable nail striking head which further includes a handle-mounted nail pulling apparatus which may be used to remove nails from narrow or tight areas.

Another object of the present invention is to provide a hammer having a replaceable nail striking head on which the nail striking head may be quickly and easily switched, even in the middle of a job, to permit the user of the hammer to avoid unnecessary delays during work.

Finally, an object of the present invention is to provide a hammer having a replaceable nail striking head which is safe and efficient in use, sturdy in construction and which provides an economical alternative to presently available hammers.

SUMMARY OF THE INVENTION

The present invention provides a hammer including an elongated handle having a top end and a bottom end and a hammer head mounted on the top end of said handle, the hammer head including a body section and a rigid nail striking head section having a nail striking face. A nail pulling device is mounted on the handle, the nail pulling device having a nail-engaging plate and at least one generally keyhole-shaped slot formed therein, the slot including an access opening having a relatively wide transverse dimension sized to receive a nail head therethrough and a narrowed groove section having a transverse dimension smaller than the transverse dimension of the access opening and sized to inhibit passage of a nail head therethrough, the nail pulling device operating such that the head of a nail to be pulled is moved through the access opening of the slot and the hammer is positioned to secure the nail in the groove section.

A very common problem encountered in the use of hammers is that the head striking face of the head section will wear out long before the rest of the hammer does. In the past, it was necessary to purchase a replacement hammer at that time which, was resulted in the expenditure of a greater amount of money than would be needed to replace merely the striking head itself. The present invention provides a solution to this problem by permitting simple, quick and efficient replacement of the head section of the hammer by merely unscrewing the head section and replacing it with a new head section which has a striking face which is in new condition. Also, previously, a worker might need to have several different hammers on his or her tool belt. The present invention, however, permits the laborer to carry only a plurality of head sections which may be quickly and easily replaced on the mounting bolt. This results in a great savings of weight for the laborer and consequently will make his or her job that much easier. Finally, it is common to find different head weights for hammers, ranging from a 28 ounce heavy striking head used for the driving of nails into wall studs or beams down to a relatively light 14 ounce finish head used for striking small nails used in the putting up of drywall. With the present invention, the laborer merely need carry a variety of head sections which are of these various weights and sizes and need merely thread the appropriate head sections onto the head section securement device in order to use any particular head section. According to the prior art, the laborer would need carry multiple hammers on his or her tool belt or in the adjacent tool box, which is not only impractical but also may be unsafe. The present invention thus provides a great advantage over the prior art.

DESCRIPTION OF THE PREFERRED EMBODIMENT

Figure 1:
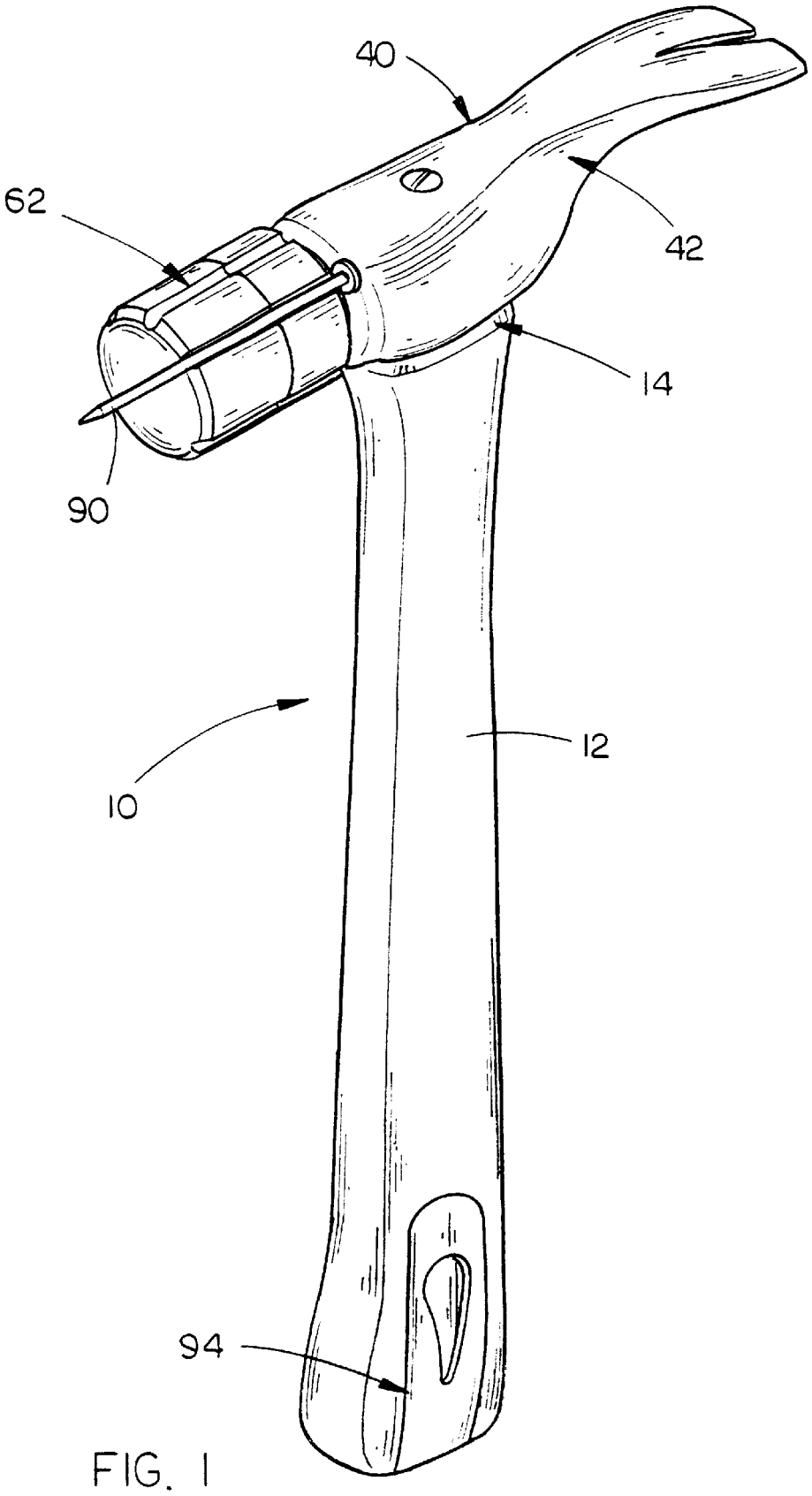
FIG. 1 is a perspective view of the hammer with replaceable head of the present invention showing a nail supported hereon.
Figure 2:
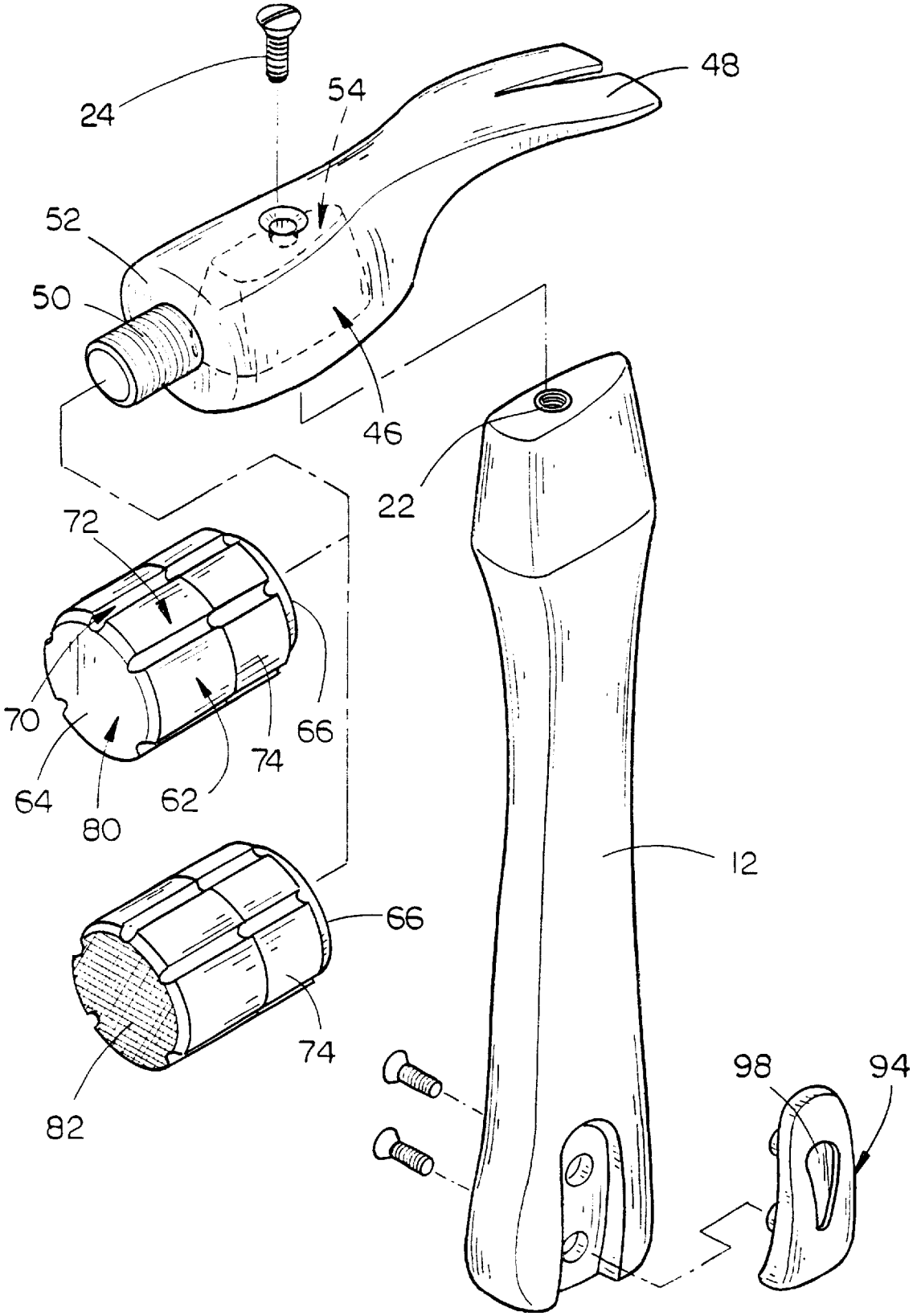
FIG. 2 is a detailed breakaway perspective view of the hammer of the present invention showing the various elements thereof.
Figure 3:
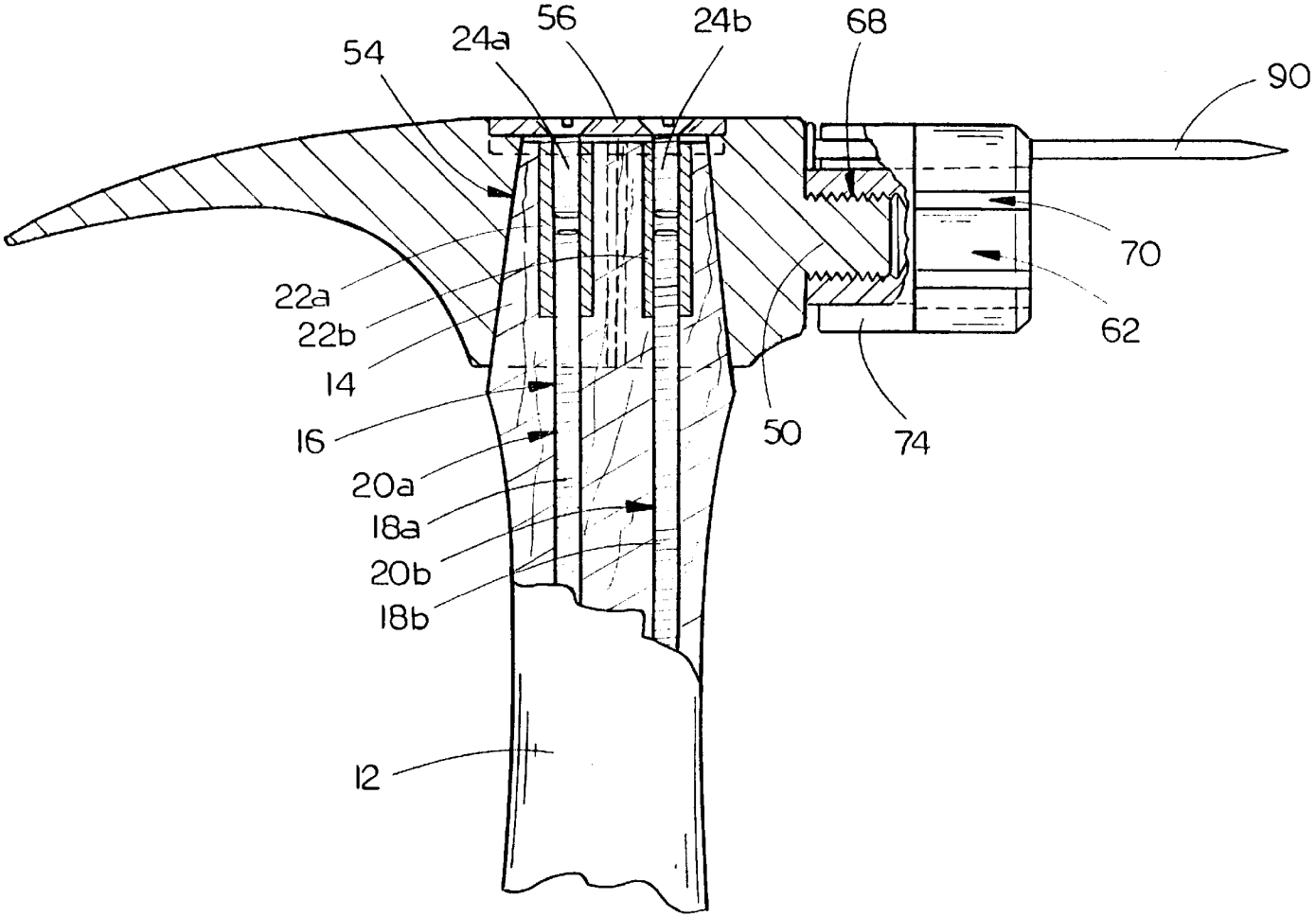
FIG. 3 is a detailed side elevational sectional view of the hammer head of the present invention showing how the hammer head is secured to the elongated hammer handle.

The hammer 10 of the present invention is best shown in FIGS. 1–3 as including an elongated handle 12 and a hammer head 40 mounted at the top end 14 of elongated handle 12. In the preferred embodiment, elongated handle 12 would be constructed of a heavy, solid wood, such as oak, and would have a length of approximately 18–28 inches. At the top end 14 of elongated handle 12 is the hammer head attachment 16 which will be described in greater detail later in this disclosure.

The hammer head 40 is best shown in FIGS. 1, 2 and 3 as including a body section 42 and a head section 62 which is removably mounted on the forward end 44 of the body section 42 of hammer head 40. It is preferred that the hammer head 40 be constructed of hardened steel or other such metal with a high tensile strength. Body section 42 preferably includes a center handle securement section 46, a claw end 48 and a head-mounting coupler which in the preferred embodiment is a threaded head mounting bolt 50 which extends generally perpendicularly to the handle 12 along a nail striking axis outwards from handle securement section 46 as shown best in FIG. 2. Of course, claw end 48 may be formed in a variety of shapes and sizes, such as a pick or the like, depending on the intended use of the hammer 10, the various shapes and designs for which are understood by those skilled in the art.

The forward end 44 of body section 42 would preferably further include a nail striking plate 52 which consists of a flattened area of handle securement section 46 adjacent the threaded head mounting bolt 50. As will be seen later, the nail striking plate 52 provides a striking area for heads of nails secured by the head section 62 such that a nail 90, as shown in FIG. 1, can be partially inserted in to the material into which the nail is to penetrate by a solid tap of the nail by the nail striking plate 52.

The head section 62 is best shown in FIGS. 2 and 3 as including forward nail striking section 64 and rearward head mounting section 66, both of which are generally cylindrical in configuration. The rearward head mounting section 66 preferably has an external diameter of approximately one inch and further includes a head-mounting receiver which in the preferred embodiment is a threaded bolt-receiving socket 68 extending axially within the rearward head mounting section 66 as shown in FIG. 3, which allows the head section 62 to be threadably secured on the mounting bolt 50 and thereby be secured on body section 42 of hammer head 40. Forward nail striking section 64 preferably has an external diameter of approximately one and a half inches and would be integrally formed with head mounting section 66 by a drop forge method or the like. Nail striking section 64 would further preferably include a plurality of axially parallel nail-receiving grooves 70 formed in the outer wall 72 of nail striking section 64. As best shown in FIGS. 1 and 3, the grooves 70 are designed to receive a nail 90 therein and releasably support the nail 90 to permit one-hand insertion of the nail 90 into the material being nailed.

Of course, by themselves, the grooves 70 are not sufficient to support the nail 90 while the hammer 10 is being moved or if the groove 70 being used is not at the top of the hammer 10. Therefore, an important feature of the present invention is inclusion of a cylindrical magnet 74 which is wrapped around the outer wall 76 of head mounting section 66 of head section 62, as shown best in FIG. 3. In the preferred embodiment, the cylindrical magnet 74 would preferably be formed of a ceramic-type magnetic material which wraps around the outer wall 76 of head mounting section 66 and is secured thereto by an acrylic resin glue or the like. It is preferred that the magnet 74 be of sufficient strength to secure a nail 90 within one of the grooves 70 (which preferably also extend along the magnet 74) yet have a weak enough magnetic field to permit release of the nail 90 once the nail 90 has partially entered the material into which the nail is being driven. The exact strength of the magnetic field which needs to be generated by the magnet 74 will vary with the size and weight of the nail 90 being driven by the hammer 10, but it is preferred that the magnet strength be sufficient to releasably secure a nail 90 within one of the grooves 70 of a size up to and including a 20 penny common nail. Of course, the size, strength and nature of the cylindrical magnet 74 may vary greatly depending upon the intended use of the hammer 10.

The hammer head attachment 16 of elongated handle 12 is best shown in FIG. 3 as including at least one threaded rod 18*a*, which extends downwards into elongated handle 12 and is preferably secured therein within at least one threaded bore hole 20*a* formed within elongated handle 12. At least one threaded sleeve 22*a* is screwed onto the threaded rod 18, as shown in FIG. 3, within handle 12, such that the top of sleeve 22 is generally flush with the top end 14 of elongated handle 12. While the hammer 10 is shown in FIG. 3 as including two threaded rods 18*a* and 18*b*, two threaded bore holes 20*a* and 20*b*, two threaded sleeves 22*a* and 22*b* and two handle securement bolts 24*a* and 24*b*, the preferred embodiment of the present invention would include only a single central threaded rod 18*a*, which has been found to sufficiently secure the hammer head 40 on the handle 12. It is to be understood, however, that so long as the "quick-change" characteristics of the handle 12 of the present invention are maintained, the precise nature of the connection between the hammer head 40 and handle 12 is not critical to the invention.

The hammer head 40 is secured to the elongated handle 12 as shown in FIGS. 2 and 3. It is preferred that the top section of elongated handle 12 taper inwards and be generally tapered in horizontal cross-section to fit within the generally tapered shaped of handle-receiving handle seat 54 found within handle securement section 46 of hammer head 40. It is preferred that handle seat 54 be tapered to have the same general shape as the top section of handle 12 so that handle 12 sits securely within the handle-receiving handle seat 54. In fact, it is desirable to round the upper corners of the handle-receiving handle seat 54 and the handle 12 in order to facilitate the replacement of the handle 12, as frictional resistance will be decreased.

To secure the handle 12 within handle-receiving seat 54, the top end 14 of handle 12 is inserted into the handle-receiving seat 54 and the threaded sleeve 22*a* within handle 12 is engaged by a handle securement bolt 24*a* extending downwards through a top plate 56 as shown in FIGS. 2 and 3. In the preferred embodiment, top 28 plate 56 would be integrally formed with hammer head 40 such that as handle securement bolt 24*a* is screwed into threaded sleeve 22, the bolt 24*a* pulls against top plate 56 thus drawing handle 12 into the handle-receiving handle seat 54 and securing hammer head 40 on elongated handle 12. Once the handle securement bolt 24*a* is securely tightened, the handle 12 and hammer head 40 are securely connected to one another, thus rendering the hammer 10 safe to use.

The handle design of the hammer 10 of the present invention is important for two reasons. First of all, the generally tapered shape of the top section of handle 12 fits within the generally tapered shape of handle-receiving seat 54 and the handle 12 is secured therein by the securement bolt 24*a* thus providing a much safer and more secure means of securing the handle 12 to the hammer head 40. Secondly, and perhaps more important, a broken or damaged handle 12 may be quickly and easily replaced by a new handle without having to replace the entire hammer 10. The handle securement bolt 24*a* is merely removed thus releasing the handle 12 and the new handle which already includes the threaded rod 18 and threaded sleeve 22 mounted therein is mounted to the hammer head 40 in the manner previously described. It is quite common for hammer handles to splinter or break during the lifetime of the handle, as the handle is generally constructed of wood and the hammer head is constructed Of a drop forged metal product which is substantially stronger than the handle itself. With the prior art, if the handle were to break on the hammer, the entire hammer would have to be discarded and a new hammer would have to purchased. Clearly, this is very inefficient, particularly if the handle is broken soon after the hammer had been purchased. In such a case, the hammer head would be in like new condition, yet would still have to be discarded. The present invention is designed to overcome those problems associated with the breaking of handles and to permit fast and simple replacement of the handle for use in connection with the original hammer head.

Likewise, the head section 62 of the hammer head 40 is designed for quick and easy replacement by another head section by merely unscrewing the head section 62 from mounting bolt 50 and attaching the new head section by connection to mounting bolt 50. A very common problem encountered in the use of hammers is that the head striking face of the head section will wear out long before the rest of the hammer does. In the past, it was necessary to purchase a replacement hammer at that time which resulted in the expenditure of a greater amount of money than would be needed to replace only the striking head itself. The present invention provides a solution to this problem by permitting simple, quick and efficient replacement of the head section 62 of the hammer 10 merely unscrewing the head section 62 from bolt 50 and replacing it with a new head 5section which has a striking face 78 which is in new condition. Furthermore, as shown in FIG. 2, the striking face of the head section 62 may be either a smooth face or a corrugated face 82, each of which are used in the framing of buildings. Commonly, the corrugated face 82 would be used in rough in sections such as the nailing of studs or the like, where as the smooth face 80 would be used for the hammering of nails in visible sections of the building such as the nailing of drywall or paneling or trim. Previously, a worker would need to have two different hammers on his or her tool belt, one having a smooth face and one having a corrugated face. The present invention, however, permits the laborer to carry only a plurality of head sections 62 which may be quickly and easily replaced on the mounting bolt 50. This results in a great savings of weight for the laborer and consequently will make his or her job that much easier and safer.

Finally, it is common to find different head weights for hammers, ranging from a 28 ounce heavy striking head used for the driving of nails into wall studs or beams down to a relatively light 14 ounce finish head used for striking small nails used in the putting up of trim. With the present invention, the laborer merely need carry a variety of head sections 62 which are of these various weights and sizes and need merely thread the appropriate head sections 62 onto the mounting bolt 50 in order to use any particular head section. According to the prior art, the laborer would need carry multiple hammers on his or her tool belt or in the adjacent tool box, which is not only impractical but also may be unsafe. The present invention thus provides a great advantage over the prior art.

Figure 4:
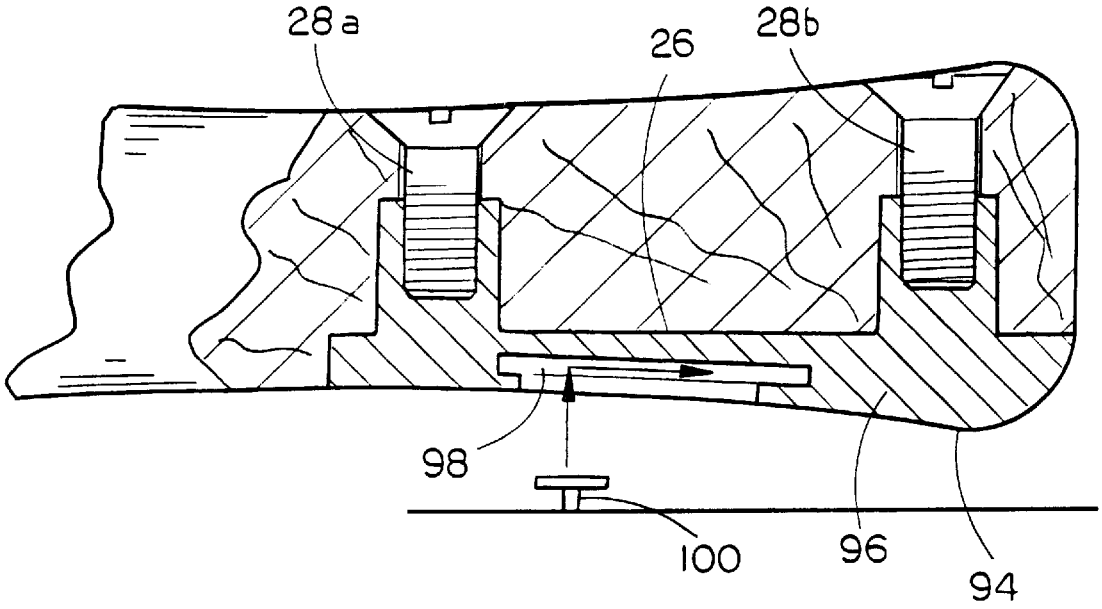
FIGS. 4 and 5 show the handle-mounted nail pulling device being used to remove a nail from a block of material.
Figure 5:
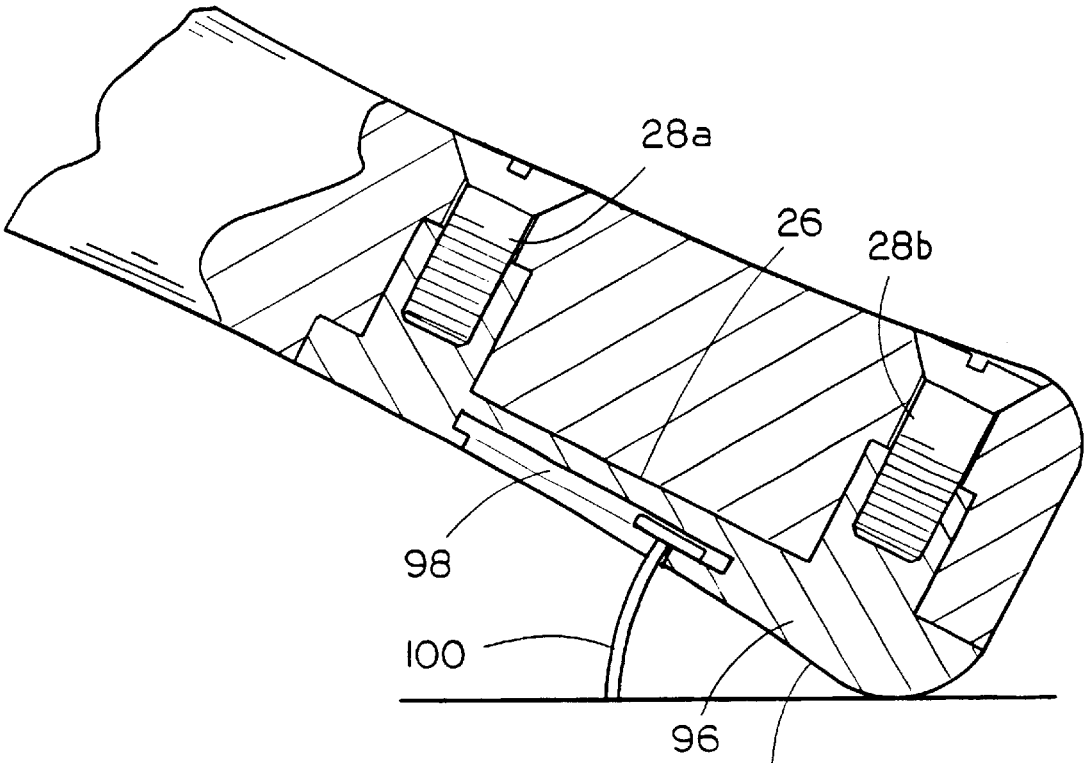

The present invention also contemplates the inclusion of a nail pulling device 94 mounted on the base of handle 12 of the hammer 10. As shown in FIGS. 2, 4 and 5, the nail pulling device 94 would preferably consist of a shaped nail-engaging metal plate 96 having at least one generally keyhole-shaped nail pulling slot 98 formed in the wall of the plate 96. A cavity 26 is formed in the base of the handle 12 and the plate 96 is positioned over the cavity 26 and secured thereon by securement screws 28*a* and 28*b* which extend through the handle 12 to the opposite side of handle 12. It may also be preferable to glue the plate 96 in place by an appropriate glue to provide additional stability. In this manner, the metal plate 96 is securely mounted on the handle 12 and stresses from the pulling of nails are distributed through the handle 12. FIGS. 4 and 5 show the nail pulling device 94 in use removing a nail 100 from a block of material. The hammer 10 is moved over the head of the nail 100 such that the head of the nail 100 is within the access opening of the keyhole-shaped slot 98, which has a relatively wide transverse dimension. The hammer is then positioned to secure the nail head within the narrowed groove section of slot 99. By moving the hammer away from the nail 100, the nail 100 can then be removed from the block of material it is within. The entire length of the handle 12 can be used to leverage the nail 100 from the block of material, thus facilitating the removal of the nail 100 and lessening the chance of injury from overstressing the arm of the user.

Clearly, the nail pulling device 94 described above can be used in a variety of nail pulling situations. Most importantly, the nail pulling device 94 acts to prevent the handle 12 from breaking off from the hammer head 40 during the pulling of the nail from the block of material into which it is inserted by eliminating the torque effect caused by use of a standard claw-type nail puller. The torque produced in the connection of the handle and the hammer head results in the loosening of the hammer head on the handle and in the case of very difficult nails, can even result in the handle snapping off. Furthermore, as the device 94 does not need a large amount of space in which to operate (as opposed to a nail removing claw), it can be used to remove nails from very tight places where it was not previously feasible to do so. Also, the slot design allows the user of the hammer 10 to gain a better grip on the nail being removed, thus preventing slippage of the nail pulling device 94 which will be safer for the user of the device. Finally, the positioning of the nail pulling device 94 adjacent the base of handle 12 permits the user to apply greater torque to the nail to remove the nail, thus making it more likely that the nail will be removed.

It is to be understood that numerous modifications, additions, and substitutions may be made to the hammer 10 of the present invention which fall within the intended broad scope of the appended claims. For example, it may be preferable to construct the handle or the hammer head out of different materials or to different specifications, depending upon the intended use of the hammer so long as the functional characteristics of the hammer are maintained. Also, the means by which the nail striking head is mounted on the hammer head body may be of any appropriate securement type, such as a snap-fit type or twist-lock type. Finally, the handle of the hammer of the present invention may be secured to the hammer head by any appropriate means, so long as the connection is safe and cannot accidentally release.

There has thus been shown and described a hammer having a replaceable nail striking head which accomplishes at least all of the stated objectives.

I claim:

1. A hammer comprising:

an elongated handle having a top end and a bottom end;

a hammer head mounted on said top end of said handle, said hammer head including a body section and a rigid nail striking head section having a nail striking face;

a nail pulling device mounted on said handle, said nail pulling device having a nail-engaging plate and at least one generally keyhole-shaped slot formed therein, said slot including an access opening having a relatively wide transverse dimension sized to receive a nail head therethrough and a narrowed groove section having a transverse dimension smaller than said transverse dimension of said access opening and sized to inhibit passage of a nail head therethrough, said nail pulling device operating such that the head of a nail to be pulled is moved through said access opening of said slot and said hammer is positioned to secure the nail in said groove section; and said body section includes a head-mounting coupler and said nail striking head section includes a head-mounting receiver complementally configured with said coupler for removably mounting said nail striking head section on said body section;

said nail striking head section further including a substantially arcuate circumferentially extending outer wall, said outer wall including at least one groove oriented substantially parallel with said nail striking axis and sized to receive at least a portion of a nail therein;

said body section further comprises a nail striking plate oriented substantially perpendicular to said nail striking axis rearwardly of said at least one groove and aligned to engage a nail placed in said at least one groove;

said nail striking plate substantially surrounding said head-mounting coupler whereby irrespective of the circumferential position of said at least one groove, a nail secured therein will be engaged by said nail striking plate during driving of the nail.

2. The hammer of claim 1 wherein said handle further comprises releasable handle securement means adjacent said top end of said handle operative to removably and replaceably connect said handle to said hammer head, whereby said handle may be quickly and easily replaced upon said handle being damaged.

3. The hammer of claim 2 wherein said handle securement means is mounted within said handle adjacent said top end of said handle having at least one threaded rod extending downwards into said elongated handle and being secured therewithin by threaded connection with at least one threaded bore hole formed within said handle; at least one threaded sleeve threadably mounted on said at least one threaded rod whereby said at least one threaded sleeve is adjacent said top end of said handle; said top end of said handle fitting within a handle-receiving handle seat formed in said body section of said hammer head; and at least one threaded securement bolt extending downwards through said body section of said hammer head into said handle seat to threadably engage said at least one threaded sleeve such that upon tightening of said securement bolt, said handle is releasably and replaceably secured to said hammer head.

4. A hammer having a replaceable nail striking head comprising:

an elongated handle having a top end and a bottom end;

a hammer head mounted on said top end of said handle, said hammer head including a body section and a rigid nail striking head section having a nail striking face at one end thereof; and head section securement means mounted on said body section of said hammer head for releasably and replaceably securing said nail striking head section of said hammer head on said body section;

a nail pulling device mounted on said handle, said nail pulling device having a nail-engaging plate and at least one generally keyhole-shaped slot formed therein, said slot including an open section to receive the head of a nail to be pulled therewithin and a narrow section to releasably secure the head of a nail there behind; and releasable handle securement means adjacent said top end of said handle operative to removably and replaceably connect said handle to said hammer head, whereby said handle may be quickly and easily replaced upon said handle being damaged, said handle securement means mounted within said handle adjacent said top end of said handle having at least one threaded rod extending downwards into said elongated handle and being secured therewithin by threaded connection with at least one threaded bore hole formed within said handle; at least one threaded sleeve threadably mounted on said at least one threaded rod whereby said at least one threaded sleeve is adjacent said top end of said handle; said top end of said handle fitting within a handle-receiving handle seat formed in said body section of said hammer head; and at least one threaded securement bolt extending downwards through said body section of said hammer head into said handle seat to threadably engage said at least one threaded sleeve such that upon tightening of said securement bolt, said handle is releasably and replaceably secured to said hammer head.

5. A hammer comprising:

an elongated handle having a top end adapted for mounting a head thereon, a bottom end and a graspable portion therebetween;

a hammer head including a body section mounted on said top end of said handle and a rigid nail striking head section having a nail striking face, said body section including a coupler extending along a nail striking axis of said head and said nail striking head section including a receiver complementally configured with said coupler for removable and replaceable mounting to said coupler and configured to require both axial movement along said nail striking axis and circumferential movement around said axis, said nail striking head section further including a substantially arcuate, circumferentially extending outer wall, said groove being oriented substantially parallel to said nail striking axis and extending substantially the entire longitudinal length of said outer wall rearwardly from said nail striking face, said body including a nail striking plate oriented rearwardly of said at least one groove, substantially perpendicular to said nail striking axis and extending radially outwardly from said coupler sufficiently to engage a nail placed in said groove during driving of the nail, a plurality of nail receiving grooves circumferentially spaced around and formed in said outer wall, said nail striking plate extending radially outwardly from said coupler and aligned to engage a nail placed in each of said grooves.

* * * * *